US010273135B2

(12) United States Patent
Bandini

(10) Patent No.: US 10,273,135 B2
(45) Date of Patent: Apr. 30, 2019

(54) MACHINE FOR FILLING CONTAINERS

(71) Applicant: SIDEL PARTICIPATIONS S.A.S., Octeville-sur-Mer (FR)

(72) Inventor: Filippo Bandini, Parma (IT)

(73) Assignee: SIDEL PARTICIPATIONS S.A.S., Octeville-sur-Mer (FR)

( * ) Notice: Subject to any disclaimer, the term of this patent is extended or adjusted under 35 U.S.C. 154(b) by 134 days.

(21) Appl. No.: 15/211,445

(22) Filed: Jul. 15, 2016

(65) Prior Publication Data

US 2017/0029259 A1 Feb. 2, 2017

(30) Foreign Application Priority Data

Jul. 31, 2015 (EP) ..... 15306252

(51) Int. Cl.

| | |
|---|---|
| ***B67C 3/00*** | (2006.01) |
| ***B67C 3/22*** | (2006.01) |
| ***B67C 3/24*** | (2006.01) |
| ***B67C 3/26*** | (2006.01) |

(52) U.S. Cl.

CPC ..... *B67C 3/225* (2013.01); *B67C 3/007* (2013.01); *B67C 3/24* (2013.01); *B67C 2003/2671* (2013.01)

(58) Field of Classification Search

CPC ..... B67C 3/225; B67C 3/007; B67C 3/24; B67C 2003/2671

USPC ..... 141/144

See application file for complete search history.

(56) References Cited

U.S. PATENT DOCUMENTS

| | | | | |
|---|---|---|---|---|
| 3,934,714 A * | 1/1976 | Matsumoto | B65G 47/244 198/379 |
| 6,398,006 B1 * | 6/2002 | Dault | B65C 9/04 198/377.01 |
| 9,522,790 B2 * | 12/2016 | Wilson | B65G 47/80 |

FOREIGN PATENT DOCUMENTS

| | | |
|---|---|---|
| DE | 10 2012 223759 A1 | 6/2014 |
| EP | 0974548 A1 | 1/2000 |
| EP | 1504998 A1 | 2/2005 |
| FR | 2857350 A1 | 1/2005 |
| WO | WO 2014/102075 A1 | 7/2014 |

OTHER PUBLICATIONS

Extended European Search Report dated Jan. 27, 2016, by the European Patent Office in counterpart European Patent Application No. 15306252.6 (7 pages).

* cited by examiner

*Primary Examiner* — Jason K Niesz
*Assistant Examiner* — James R Hakomaki
(74) *Attorney, Agent, or Firm* — Finnegan, Henderson, Farabow, Garrett & Dunner LLP

(57) ABSTRACT

A machine for filling containers, comprising: a conveying device; a plurality of handling units configured to be moved by the conveying device along a path, each of the plurality of handling units having: a support device configured to receive and retain a corresponding container; and a filling device configured to feed a pourable product into the container; and at least one actuator associated with the plurality of handling units and configured to rotate each support device about a corresponding first rotation axis, the at least one actuator including a single motor and a transmission to connect the single motor with at least two support devices.

20 Claims, 5 Drawing Sheets

MACHINE FOR FILLING CONTAINERS

CROSS-REFERENCE TO RELATED APPLICATIONS

This application claims the benefit of priority of European Patent Application No, 15306252.6, filed on Jul. 31, 2015, which is incorporated herein by reference.

TECHNICAL FIELD

The present invention relates to a machine for filling containers, such as bottles, with pourable products, such as carbonated liquids, non-carbonated liquids, emulsions, suspensions and high viscosity liquids.

BACKGROUND ART

As is known, many pourable products are sold in a wide range of containers, which are sterilized, filled and closed in container handling plants typically including a plurality of processing stations or machines, such as rinsing machines, filling machines, capping machines and labelling machines.

The containers to be handled are generally fed to and removed from these machines by means of a transport system including star wheels and linear conveyors.

Each filling machine generally comprises a conveying wheel, which is mounted to rotate about a rotation axis, and is provided with a plurality of handling units, which are mounted along a peripheral edge of the conveying wheel, and are fed by the conveying wheel along a path extending about the rotation axis.

Each handling unit comprises a support device for receiving and retaining a relative container and a filling device for feeding a pourable product into the container.

A problem of known filling machines is the formation of foam at the end of the operation of filling the container.

This problem is mainly caused by the fact that, for reasons of economy, commercial containers are not much larger than the volume required for accommodating the contents. Thus, during filling operations, which have to be carried out at high speed, it is common for some amount of liquid in the form of foam to bubble over the top of the container prior to the container being capped or sealed. The product loss can be as high as ten percent, which translates into higher cost for the consumer or lower profitability for the bottler, or both.

To reduce this product loss, each support device is rotated about a longitudinal axis of the container while the container is filled with the pourable product by the corresponding filling device.

Known filling machines of the type described above have some drawbacks mainly deriving from the fact that each support device is generally rotated about the longitudinal axis of the relative container by an electric motor, whose output shaft is connected with the support device by means of a pair of gears.

Known filling machines of the type described above are thus relatively complex and costly due to the high number of electric motors and transmission gears.

DISCLOSURE OF INVENTION

It is an object of the present invention to provide a machine for filling containers, designed to eliminate at least one of the aforementioned drawbacks, and which is cheap and easy to implement.

According to the present invention, there is provided a machine for filling containers as claimed in the appended claims.

BRIEF DESCRIPTION OF THE DRAWINGS

A non-limiting embodiment of the present invention will be described by way of example with reference to the accompanying drawings, in which.

PREFERRED EMBODIMENT OF THE INVENTION

Figure 1:
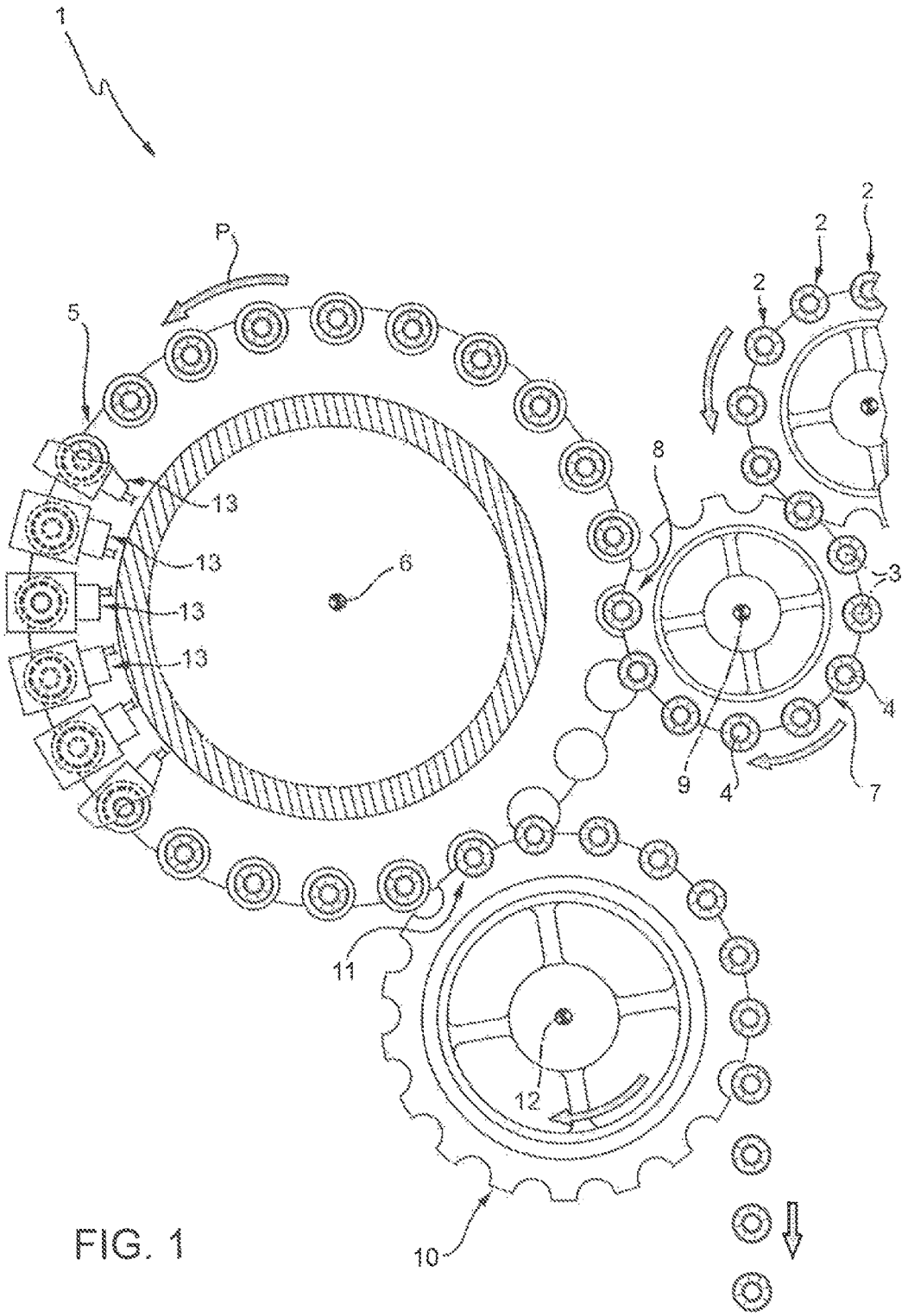
FIG. 1 shows a schematic top plan view, with parts removed for clarity, of a preferred embodiment of a machine for filling containers according to the present invention.

Number 1 in FIG. 1 indicates as a whole a machine for filling containers, in particular bottles 2, with pourable products, such as carbonated liquids, non-carbonated liquids, emulsions, suspensions and high viscosity liquids.

Each bottle 2 has a longitudinal axis 3 and has a top neck 4 substantially coaxial with the axis 3.

The machine 1 comprises a filling wheel 5, which is mounted to rotate continuously (anticlockwise in FIG. 1) about a vertical axis 6 perpendicular to the FIG. 1 plane. The wheel. 5 receives a succession of empty bottles 2 from an input star wheel 7, which is connected to the wheel 5 at a first transfer station 8 and is mounted to rotate continuously about a respective longitudinal axis 9 parallel to axis 6.

The wheel 5 releases a succession of filled bottles 2 to an output star wheel 10, which is connected to the wheel 5 at a second transfer station 11 and is mounted to rotate continuously about a respective longitudinal axis 12 parallel to axes 6 and 9.

Wheel 5 is provided with a plurality of handling units 13, which are equally angularly spaced about the axis 6, are mounted along a peripheral edge of the wheel 5, and are moved by the wheel 5 along a path P extending about axis 6 and through the stations 8 and 11.

Figure 3:
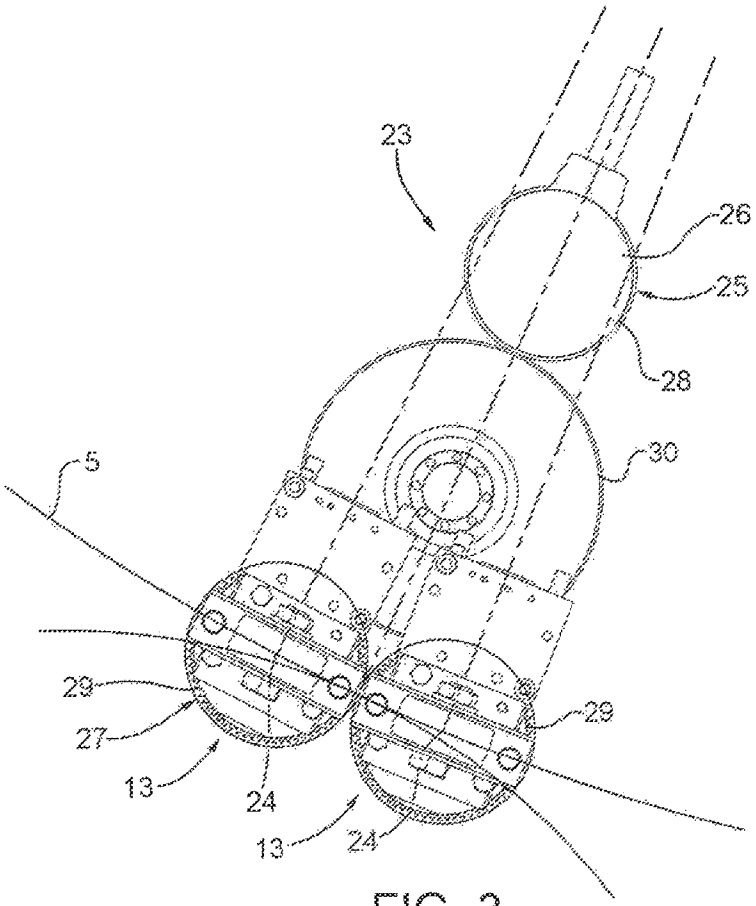
FIG. 3 shows a schematic top plan view, with parts removed for clarity, of the detail of FIG. 2.
Figure 2:
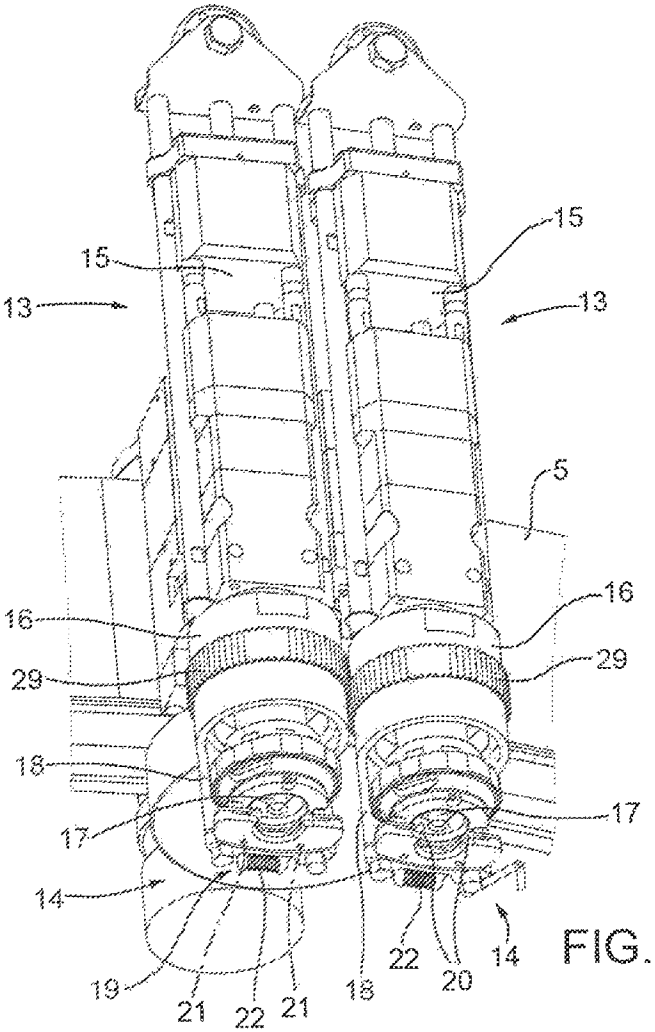
FIG. 2 shows a schematic perspective view, with parts removed for clarity, of a detail of the filling machine of FIG. 1.

As shown in FIGS. 2 and 3, each handling unit 13 comprises a support device 14 adapted to receive and retain a relative bottle 2 in a vertical position, in which the bottle 2 has its axis 3 parallel to the axis 6 of the wheel 5, and a filling device 15 of the known type, which is arranged above the bottle 2 to be filled for feeding the pourable product into the bottle 2 as the support device 14 is fed along the path P.

The support device 14 comprises a cylindrical sleeve 16, which extends around the filling device 15 coaxially to a filling head 17 of the filling device 15, and is coupled to the filling device 15 in a rotary manner so as to rotate around the longitudinal axis 3 of the corresponding bottle 2 with respect to the filling device 15.

The sleeve 16 is provided with a semi-cylindrical plate 18, which projects downwards from the sleeve 16, and supports a gripping member 19.

The gripping member 19 comprises a pair of holding jaws 20, which are configured to hold a relative bottle 2 in correspondence to its top neck 4, and are hinged to the plate 18 so as to rotate, relative to the plate 18 itself, around respective fulcrum axes 21, which are parallel to one another and to the axis 6.

The jaws 20 are moved to a clamping position—and normally kept there—by a spring 22, which is interposed between the jaws 20, and are moved to a release position by the thrust exerted upon the jaws 20 themselves by the relative bottle 2 during its insertion into the gripping member 19 or its extraction from the gripping member 19.

The wheel 5 is further provided with a plurality of actuator devices 23 to rotate the cylindrical sleeves 16 and, thus, the gripping members 19 around a rotation axis 24 coincident with the longitudinal axes 3 of the corresponding bottles 2.

In the example shown, each actuator device 23 is configured to rotate the gripping members 19 of two handling units 13, and comprises a single electric motor 25 having a casing 26 secured to the wheel 6 and an output shaft coupled to the corresponding sleeves 16 by means of a gear transmission 27.

The gear transmission 27 comprises a first gear 28 coupled to the output shaft of the electric motor 25; for each sleeve 16, a respective second gear 29 provided on the outer surface of the sleeve 16; and a third gear 30 interposed between the gear 28 and the gears 29.

In the example shown in FIGS. 2 and 3, the electric motor 25 is located on the convex side of the path P, i.e. between the rotation axis 6 of the wheel 5 and the rotation axes 24 of the sleeves 16.

Figure 5:
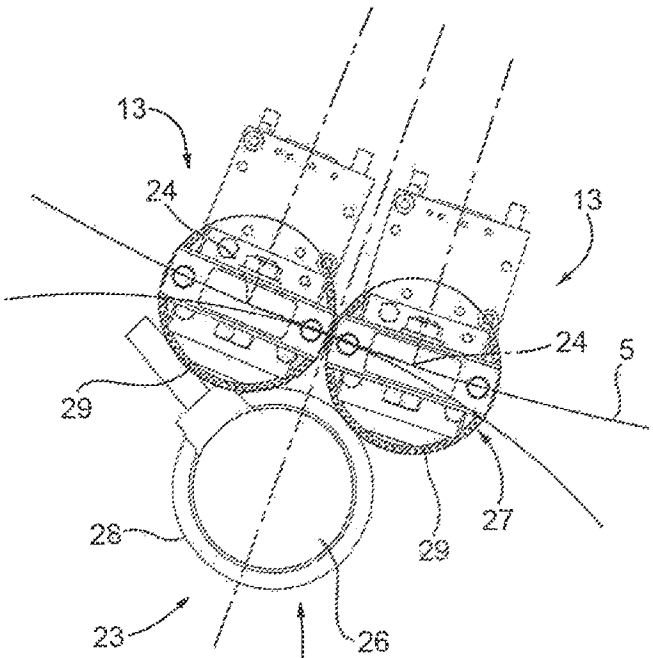
FIG. 5 shows a schematic top plan view, with parts removed for clarity, of the variant of FIG. 4.
Figure 4:
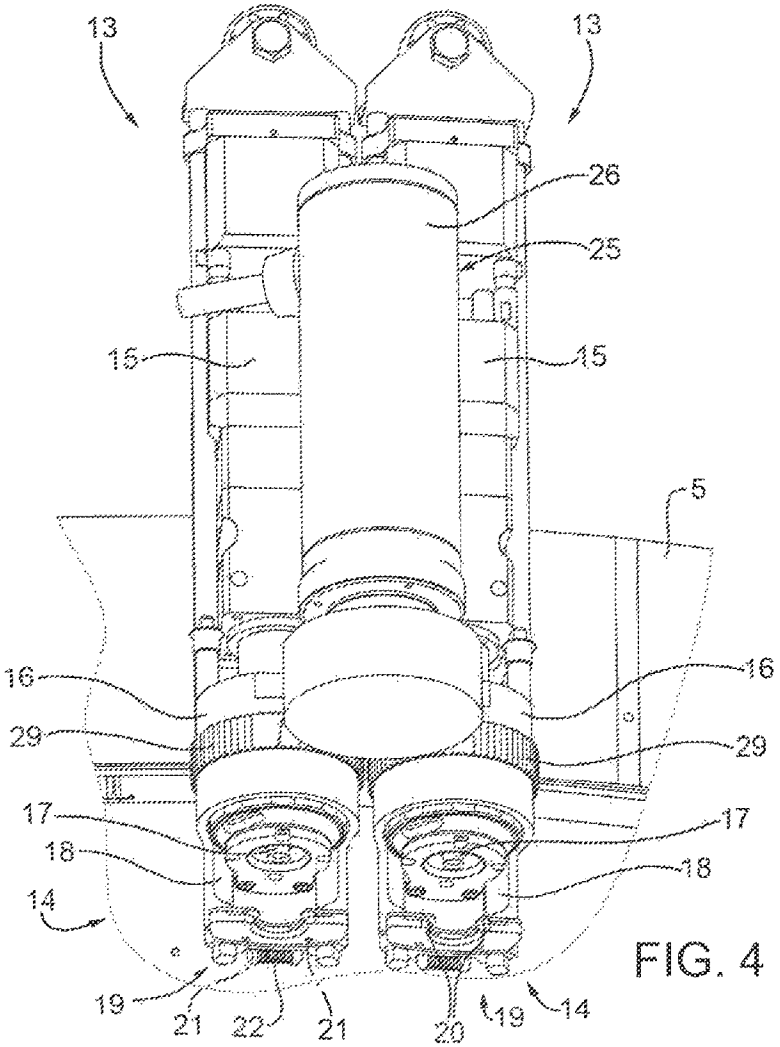
FIG. 4 shows a schematic perspective view, with parts removed for clarity, of a first variant of the detail of FIGS. 2 and 3.

The embodiment shown in FIGS. 4 and 5 differs from the embodiment shown in FIGS. 2 and 3 only in that the gear 30 is eliminated, the electric motor 25 is located on the concave side of the path P, the casing 26 is secured to at least one filling head 17, and the gear 28 is directly coupled to the gears 29.

Figure 7:
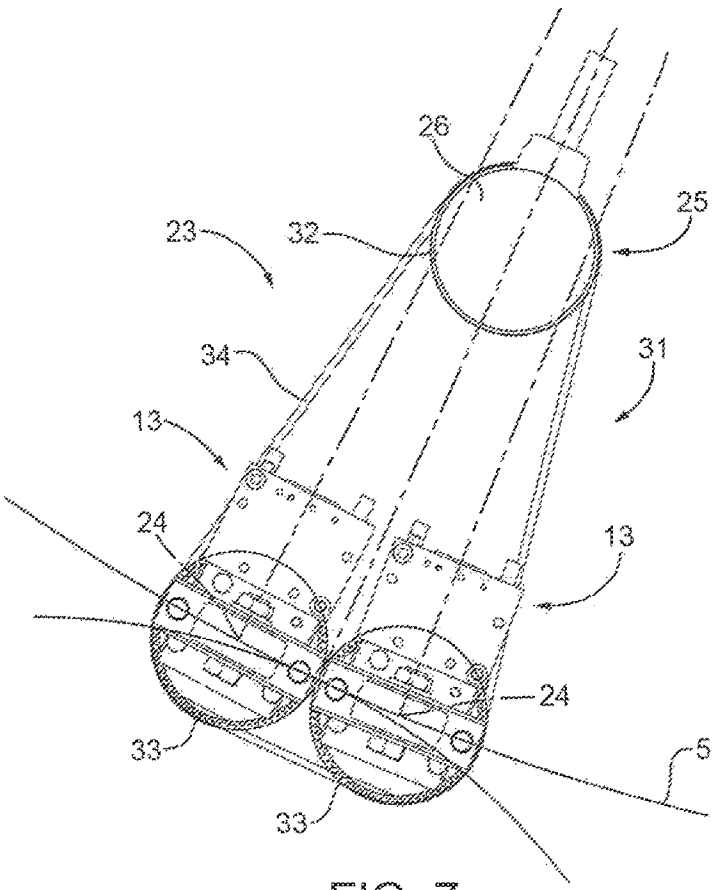
FIG. 7 shows a schematic top plan view, with parts removed for clarity, of the variant of FIG. 6.
Figure 6:
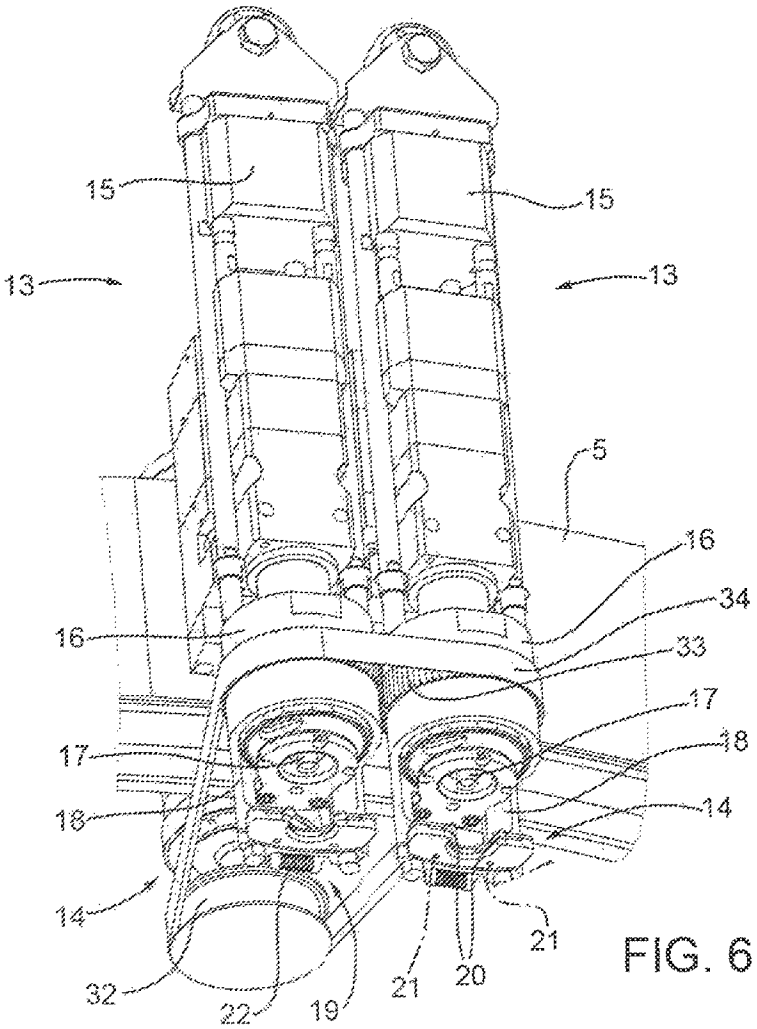
FIG. 6 shows a schematic perspective view, with parts removed for clarity, of a second variant of the detail of FIGS. 2 and 3.

The embodiment shown in FIGS. 6 and 7 is similar to the embodiment shown in FIGS. 2 and 3, i.e. the casing 26 of the electric motor 25 is secured to the wheel 6 between the rotation axis 6 of the wheel 5 and the rotation axes 24 of the sleeves 16, while the gear transmission 27 is eliminated and replaced with a belt transmission 31 comprising a first pulley 32 coupled to the output shaft of the electric motor 25; for each sleeve 16, a respective second pulley 33 provided on the outer surface of the sleeve 16; and a belt 34 wound around pulleys 32 and 33.

Figure 9:
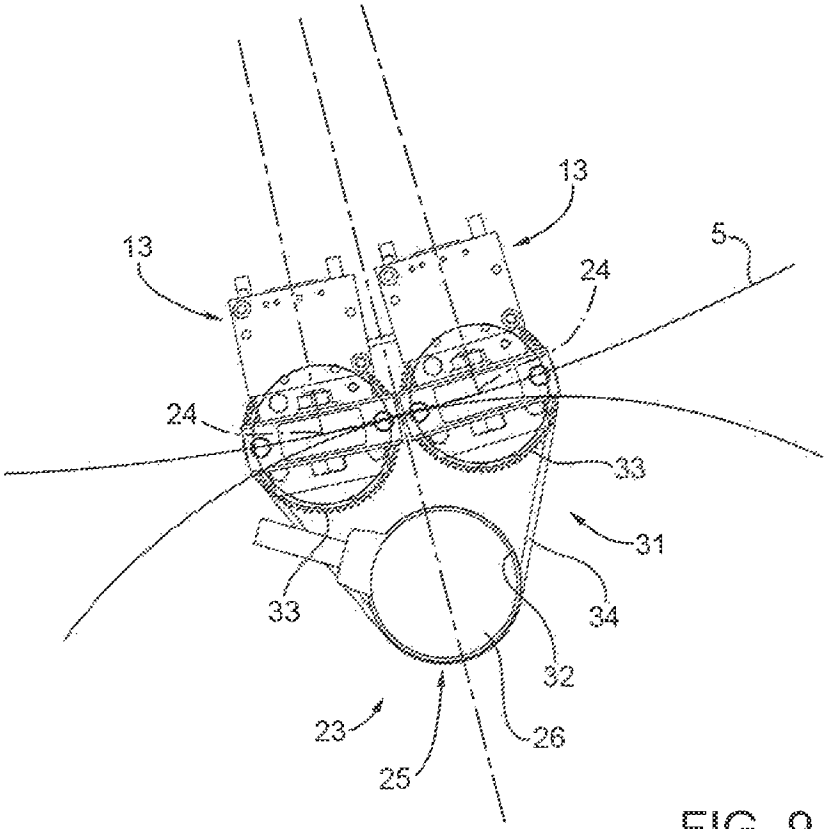
FIG. 9 shows a schematic top plan view, with parts removed for clarity, of the variant of FIG. 8.
Figure 8:
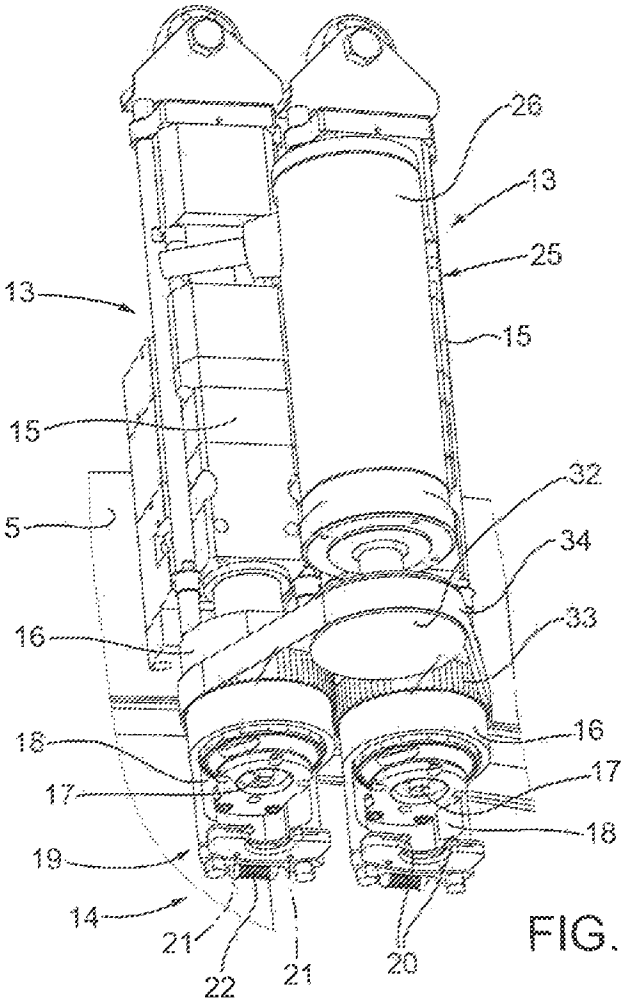
FIG. 8 shows a schematic perspective view, with parts removed for clarity, of a third variant of the detail of FIGS. 2 and 3.

The embodiment shown in FIGS. 8 and 9 differs from the embodiment shown in FIGS. 6 and 7 only in that the electric motor 25 is located on the concave side of the path P and the casing 26 is secured to at least one filling head 17.

According to an alternative not shown herein, the belt 34 is eliminated and replaced by a chain.

According to a further alternative not shown herein, each gripping member 19 is eliminated and replaced by a support plate adapted to receive a relative bottle 2 in a vertical position, i.e. resting on the support plate 15 with its axis 3 extending vertically. More specifically, the bottle 2 is arranged with its bottom wall in contact with the support plate and extends vertically from the latter, while the support plate is mounted to rotate around the axis 3 of the bottle 2 itself.

Due to the relatively low number of actuator devices 23 and, thus, electric motors 25, the advantages of the filling machine 1 according to the present invention will be clear from the foregoing description.

The invention claimed is:

1. A machine for filling bottles with pourable products, each bottle having a longitudinal axis and a neck substantially coaxial with the longitudinal axis, the machine comprising:

a filling wheel rotatable about a vertical axis;

an input star wheel rotatable about a longitudinal input axis parallel to the vertical axis of the filling wheel and delivering a succession of empty bottles to the filling wheel at a first transfer station;

an output star wheel rotatable about a longitudinal output axis parallel to the vertical axis of the filling wheel and receiving a succession of filled bottles from the filling wheel at a second transfer station;

a plurality of handling units equally angularly spaced about the vertical axis along a periphery of the filling wheel and configured to be moved by the filling wheel along a path, the path including a curvilinear portion extending about the vertical axis and through the first and second transfer stations, wherein each of the plurality of handling units includes:

a support device configured to receive and retain a bottle in a vertical position, at which a longitudinal axis of the bottle is parallel to the vertical axis of the filling wheel; and a filling device having a filling head arranged above the support device and configured to feed a pourable product into the bottle as the support device is fed along the path, wherein each support device includes:

a cylindrical sleeve extending around the filling device coaxially to the filling head and coupled to the filling device in a rotatable manner;

a plate projecting from the sleeve; and a gripping member, wherein the gripping member has:

a pair of jaws, hinged to the plate about fulcrum axes, extending parallel to each other and parallel to the vertical axis, the jaws being rotatable relative to the plate about the fulcrum axes for clamping the neck of a bottle therebetween; and a device for maintaining the jaws in a closed clamping position, the jaws being configured to be moved into a release position by thrust exerted on the jaws during insertion of the bottle into the gripping member and by thrust exerted on the jaws during extraction of the bottle from the gripping member;

wherein the filling wheel includes a plurality of actuator devices each configured to rotate the cylindrical sleeve and the pair of jaws of the gripping member of the handling units, each of the plurality of actuator devices including:

a single motor having a casing secured to the filling wheel and an output shaft; and a transmission coupling the output shaft to the cylindrical sleeve of at least two gripping members of at least two handling units, and wherein the actuator is configured to rotate the sleeve and the jaws of the gripping member about a rotation axis coincident with the longitudinal axis of the bottle gripped between the jaws.

2. The machine as claimed in claim 1, wherein the single motor is an electric motor, and wherein the transmission includes a gear transmission to connect the single motor with at least two support devices.

3. The machine as claimed in claim 2, wherein the gear transmission includes a first gear provided on the output shaft and, for each support device, a corresponding second gear provided on the respective support device and coupled to the first gear.

4. The machine as claimed in claim 1, wherein the single motor is an electric motor, and wherein the transmission includes a belt transmission or a chain transmission to connect the single motor with at least two support devices.

5. The machine as claimed in claim 4, wherein the belt transmission or the chain transmission includes a first pulley fitted to the output shaft, a second pulley fitted to each support device, and a belt or a chain wound around the first pulley and the second pulley.

6. The machine as claimed in claim 1, wherein the single motor is located on a convex side of the curvilinear portion.

7. The machine as claimed in claim 1, wherein the single motor is located on a concave side of the curvilinear portion.

8. The machine as claimed in claim 1, wherein the single motor is secured to at least one support device.

9. The machine as claimed in claim 1, wherein each support device is configured to rotate about a corresponding rotation axis that coincides with a longitudinal axis of the corresponding container.

10. The machine as claimed in claim 1, wherein:

the plate comprises a downwardly projecting portion; and the device for maintaining the jaws in the closed clamping position is interposed between the jaws.

11. A machine for filling bottles with pourable products, each bottle having a longitudinal axis and a neck substantially coaxial with the longitudinal axis, the machine comprising:

a filling wheel rotatable about a vertical axis;

a plurality of handling units equally angularly spaced about the vertical axis along a periphery of the filling wheel and configured to be moved by the filling wheel along a path, the path including a curvilinear portion extending about the vertical axis and through the first and second transfer stations, wherein each of the plurality of handling units includes:

a support device configured to receive and retain a bottle in a vertical position, at which a longitudinal axis of the bottle is parallel to the vertical axis of the filling wheel; and a filling device including a filling head arranged above the support device and configured to feed a pourable product into the bottle as the support device is fed along the path, wherein each support device includes:

a cylindrical sleeve extending around the filling device coaxially to the filling head and coupled to the filling device in a rotatable manner;

a plate projecting from the sleeve; and a gripping member, wherein the gripping member includes:

a pair of jaws, hinged to the plate about fulcrum axes, extending parallel to each other and parallel to the vertical axis, the jaws being rotatable relative to the plate about the fulcrum axes for clamping a neck of a bottle therebetween; and a device for maintaining the jaws in a closed clamping position, the jaws being configured to be moved into a release position by thrust exerted on the jaws during insertion of the bottle into the gripping member and by thrust exerted on the jaws during extraction of the bottle from the gripping member;

wherein the filling wheel includes a plurality of actuator devices each configured to rotate the cylindrical sleeve and the pair of jaws of the gripping member of the handling units, each of the plurality of actuator devices having:

a single motor having a casing secured to the filling wheel and an output shaft; and a transmission coupling the output shaft to the cylindrical sleeve of at least two gripping members of at least two handling units, and wherein the actuator is configured to rotate the sleeve and the jaws of the gripping member about a rotation axis coincident with the longitudinal axis of the bottle gripped between the jaws.

12. The machine as claimed in claim 11, wherein the single motor is an electric motor, and wherein the transmission includes a gear transmission to connect the single motor with at least two support devices.

13. The machine as claimed in claim 12, wherein the gear transmission includes a first gear provided on the output shaft and, for each support device, a corresponding second gear provided on the respective support device and coupled to the first gear.

14. The machine as claimed in claim 11, wherein the single motor is an electric motor, and wherein the transmission includes a belt transmission or a chain transmission to connect the single motor with at least two support devices.

15. The machine as claimed in claim 14, wherein the belt transmission or the chain transmission includes a first pulley fitted to the output shaft, a second pulley fitted to each support device, and a belt or a chain wound around the first pulley and the second pulley.

16. The machine as claimed in claim 11, wherein the single motor is located on a convex side of the curvilinear portion.

17. The machine as claimed in claim 11, wherein the single motor is located on a concave side of the curvilinear portion.

18. The machine as claimed in claim 11, wherein the single motor is secured to at least one support device.

19. The machine as claimed in claim 11, wherein each support device is configured to rotate about a corresponding rotation axis that coincides with a longitudinal axis of the corresponding container.

20. The machine as claimed in claim 11, wherein:

the plate comprises a downwardly projecting portion; and the device of maintaining the jaws in the closed clamping position is interposed between the jaws.

* * * * *